US006031506A

United States Patent [19]

Cooley et al.

[11] Patent Number: 6,031,506

[45] **Date of Patent: *Feb. 29, 2000**

[54] METHOD FOR IMPROVING PATTERN BANDWIDTH OF SHAPED BEAM REFLECTARRAYS

[75] Inventors: Michael E. Cooley, Newbury Park; Thomas J. Chwalek, Hawthorne; Parthasarath Ramanujam, Redondo Beach, all of Calif.

[73] Assignee: Hughes Electronics Corporation, El Segundo, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/889,604

[22] Filed: Jul. 8, 1997

[51] Int. Cl.[7] ..... H01Q 15/16; H01Q 19/12

[52] U.S. Cl. ..... 343/840; 343/914; 343/700 MS

[58] Field of Search ..... 359/483, 485, 359/486, 838, 868, 871, 900; 343/756, 909, 700 MS, 781 P, 781 CA, 840, 914

[56] References Cited

U.S. PATENT DOCUMENTS

| | | | |
|---|---|---|---|
| 3,681,769 | 8/1972 | Perrutti et al. . | |
| 3,718,935 | 2/1973 | Ranghelli et al. . | |
| 3,925,784 | 12/1975 | Phelan . | |
| 4,054,874 | 10/1977 | Oltman, Jr. | 343/700 MS |
| 4,352,108 | 9/1982 | Milne | 343/756 |
| 4,684,952 | 8/1987 | Munson et al. . | |
| 4,733,244 | 3/1988 | Edenhofer et al. | 343/756 |
| 5,283,590 | 2/1994 | Wong . | |
| 5,543,809 | 8/1996 | Profera, Jr. | 343/756 |

FOREIGN PATENT DOCUMENTS

| | | |
|---|---|---|
| 1469156 | 3/1977 | United Kingdom . |

*Primary Examiner*—Ricky D. Shafer
*Attorney, Agent, or Firm*—Georgann S. Grunebach; M. W. Sales

[57] ABSTRACT

A method for shaping reflected radio frequency signals includes geometrically shaping a reflector surface of an antenna to focus the beam, and reflectively shaping the reflector surface with phasing elements that emulate geometric shaping to configure the beam to a predetermined shape. In the preferred embodiment, the antenna comprises a geosynchronous satellite antenna conveying signals from a wave guide horn to or from a predetermined geographic area on earth. The use of a parabolic-approaching surface of reflectarray phasing elements for shaping the beam substantially improves the beam pattern bandwidth over the performance of previously known shaped beam reflectarrays.

4 Claims, 3 Drawing Sheets

FIG 3
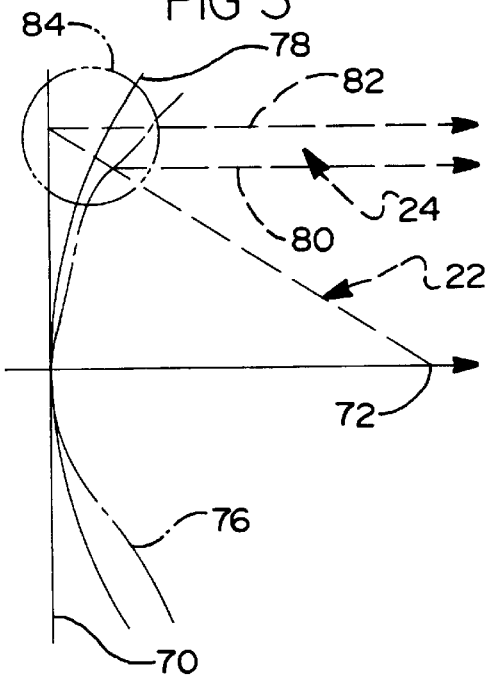
FIG 4
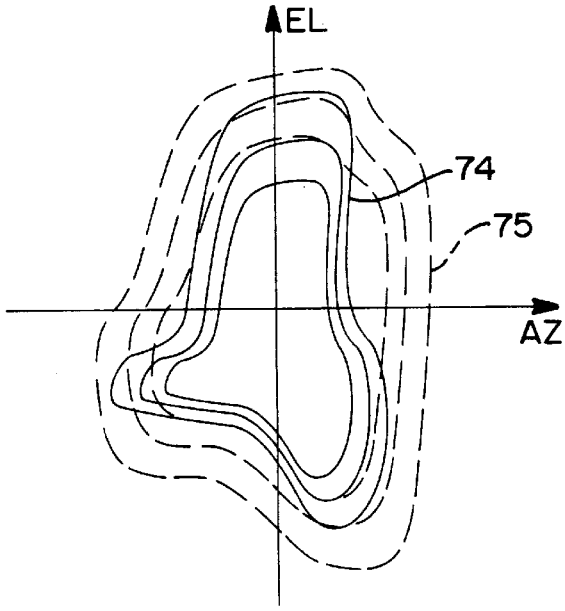
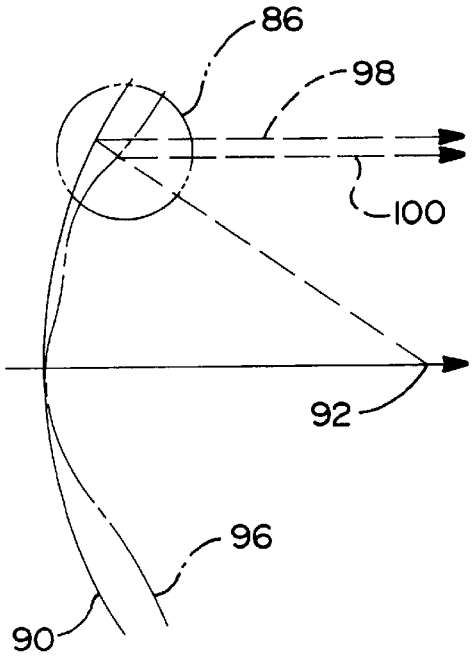
FIG 5
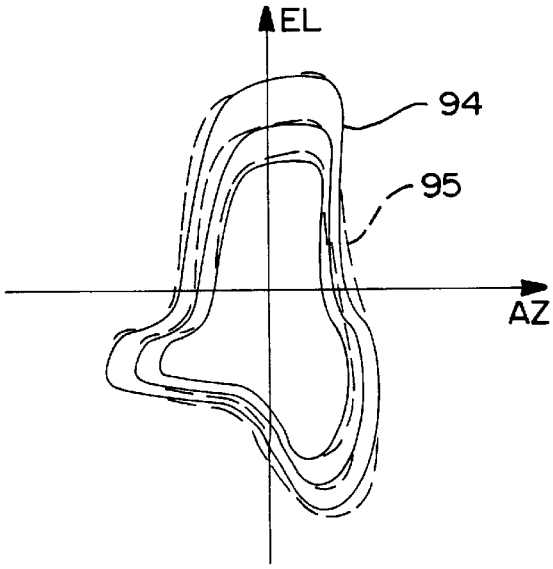
FIG 6

METHOD FOR IMPROVING PATTERN BANDWIDTH OF SHAPED BEAM REFLECTARRAYS

BACKGROUND OF THE INVENTION

1. Field of the Invention

The present invention relates to reflectarray antennas for signal transmission to or reception from a geographic area whereby the reflectarray shapes the beam over the defined area.

2. Background Art

Radio frequency communication signals are transmitted or received via antennas. For example, a satellite antenna in geosynchronous orbit is typically designed to cover a geographic area. Conventional parabolic reflectors have been physically reshaped to form beams which are collimated over specified geographical areas. Reflectarrays can also be designed to form beams collimated over specific geographical areas.

Parabolic reflectors, when fed by a single radio frequency feed at the focus, generate pencil shaped beams. Optical techniques such as geometrical ray tracing demonstrate that all ray paths from the focus to any point on the reflector to the far field (on a reference plane), are of equal length. Consequently, such reflectors form focused pencil beams for all frequencies at which the feed operates. The pattern bandwidth of parabolic reflectors is thus limited only by the modest bandwidth variations which occur due to changes in the electrical size (wavelengths) of the reflector. These bandwidth variations are inversely proportional to the frequency of the signal waves, for example frequency increases of ten percent will reduce the bandwidth by the same amount.

Shaped reflectors generally have small variations in ray path electrical lengths, and consequently, the associated pattern bandwidths are relatively good. However, the reflector shape is unique for each different coverage area and thus the mechanical design and manufacturing process is highly customized for each different application. The cost and design/manufacture cycle times associated with these reflectors are driven by their customized shapes. It is known that performance similar to that of shaped reflectors can be achieved in a flat antenna with reflectarrays. Typically, a reflectarray includes a flat surface upon which surface elements perturb the reflection phase of the waves directed upon the surface so that the reflected waves form a beam over the desired coverage area in much the same manner as they do in an equivalent shaped reflector design. Significant cost and cycle time reductions can be realized with flat reflectarrays wherein a common surface shape, i.e., flat, is employed. Customized beam shapes are synthesized by varying only the printed element pattern on the reflectarray surface.

However, flat reflectarrays are subject to two pattern bandwidth limitations. The first limitation is due to variations in ray path electrical lengths that are inherent to reflectarray systems. The second limitation arises from reflectarray element phase variations as a function of the frequency of the wave impinging upon the element. These elemental effects further degrade the reflectarray bandwidth. As a result, attempts to configure the shape of the beam reflected from a reflectarray to a beam shape, defining a coverage area, are subject to losses that substantially reduce pattern bandwidth and thus limit the utility of the antenna for use over a band of frequencies.

SUMMARY OF THE PRESENT INVENTION

The present invention overcomes abovementioned disadvantages by providing a method for improving the pattern bandwidth of a shaped beam reflectarray antenna. In general, the present invention overcomes the above-mentioned disadvantages by limiting the frequency variations in ray path electrical lengths so as to reduce beamshape variations over a frequency band. As a result, the bandwidth limitations typically associated with previously known flat reflectarray arrangements are substantially improved.

In the preferred embodiment, parabolic shaping of the reflector surface is employed in conjunction with the use of surface phasing elements, to reduce the ray path electrical length variations and collimate a shaped antenna beam. As a result, the substantial pattern bandwidth limitations associated with previously known reflectarrays are reduced. Furthermore, the present invention retains the forementioned cost and cycle time advantages since it utilizes a common reflector surface shape, preferably parabolic, to achieve customized beam shapes.

Thus, the present invention provides a method of improving bandwidth of a shaped beam pattern by combining geometric surface shaping with surface phasing on a reflectarray surface. In addition, the present invention provides a reflectarray for shaped beam antenna applications including a shaped surface, preferably parabolic in shape, to generate a focused beam via reflection of an impinging source beam and surface phasing elements carried by the shaped surface for configuring the focused beam.

BRIEF DESCRIPTION OF THE DRAWING

The present invention will be more clearly understood by reference to the following detailed description of a preferred embodiment when read in conjunction with the accompanying drawing in which like reference characters refer to like parts throughout the views and in which:

FIG. 3 is a two-dimensional sketch of a flat reflectarray, an equivalent shaped reflector, and the associated shaped beam contour pattern;

FIG. 4 is a plan view of a beam coverage area for the flat reflectarray of FIG. 3 simulating an effect on area as a function of frequency in the pattern bandwidth;

FIG. 5 is a two-dimensional sketch of a parabolic reflectarray constructed according to the present invention, an equivalent shaped reflector and the associated shaped beam contour pattern; and FIG. 6 is a plan view of a beam coverage area for the parabolic reflectarray of FIG. 5 simulating an effect on area as a function of frequency in the pattern bandwidth.

DETAILED DESCRIPTION OF A PREFERRED EMBODIMENT

Figure 1:
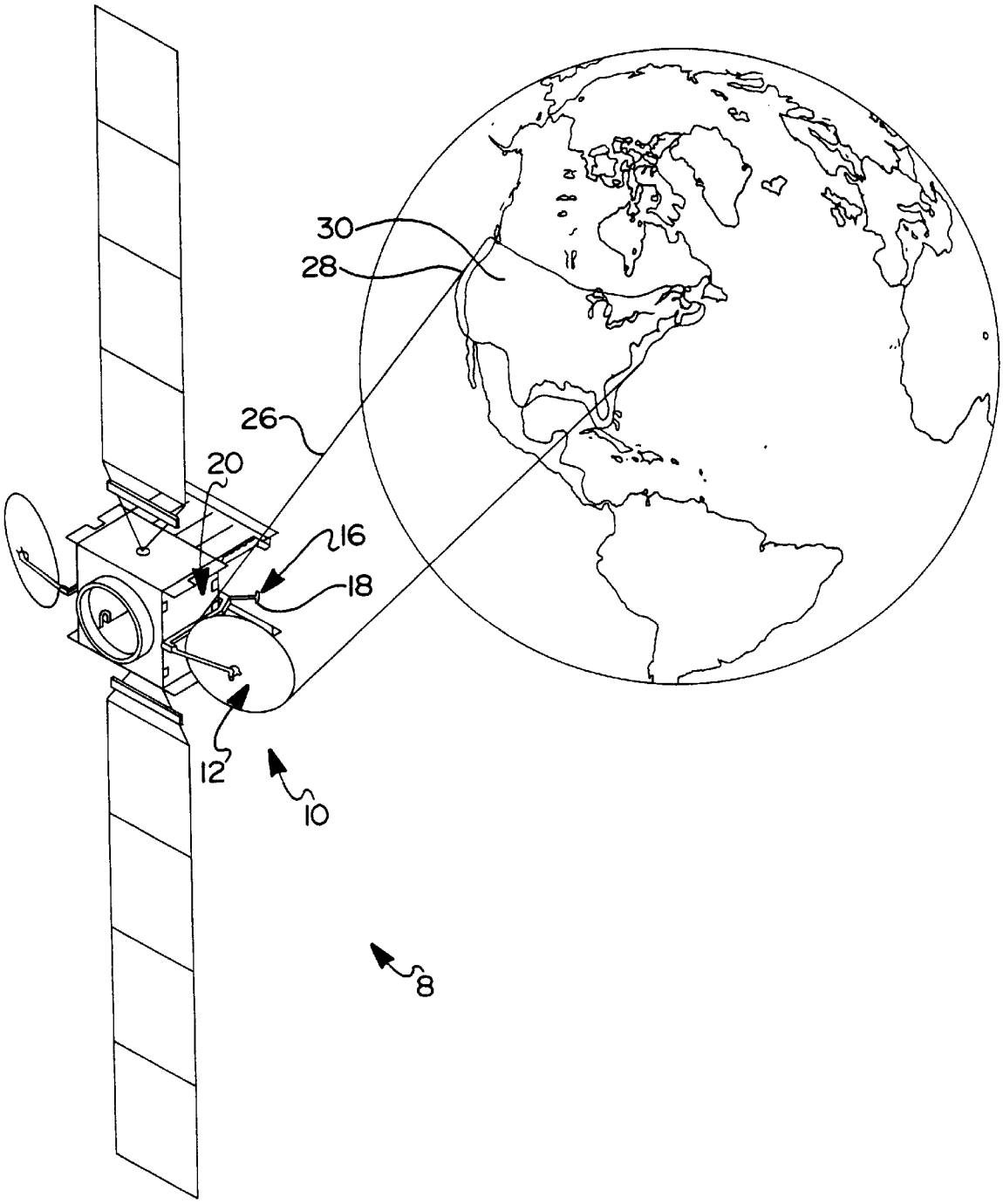
FIG. 1 is a diagrammatic view of a satellite with a functioning communication system payload including a reflectarray constructed according to the method of the present invention.
Figure 2:
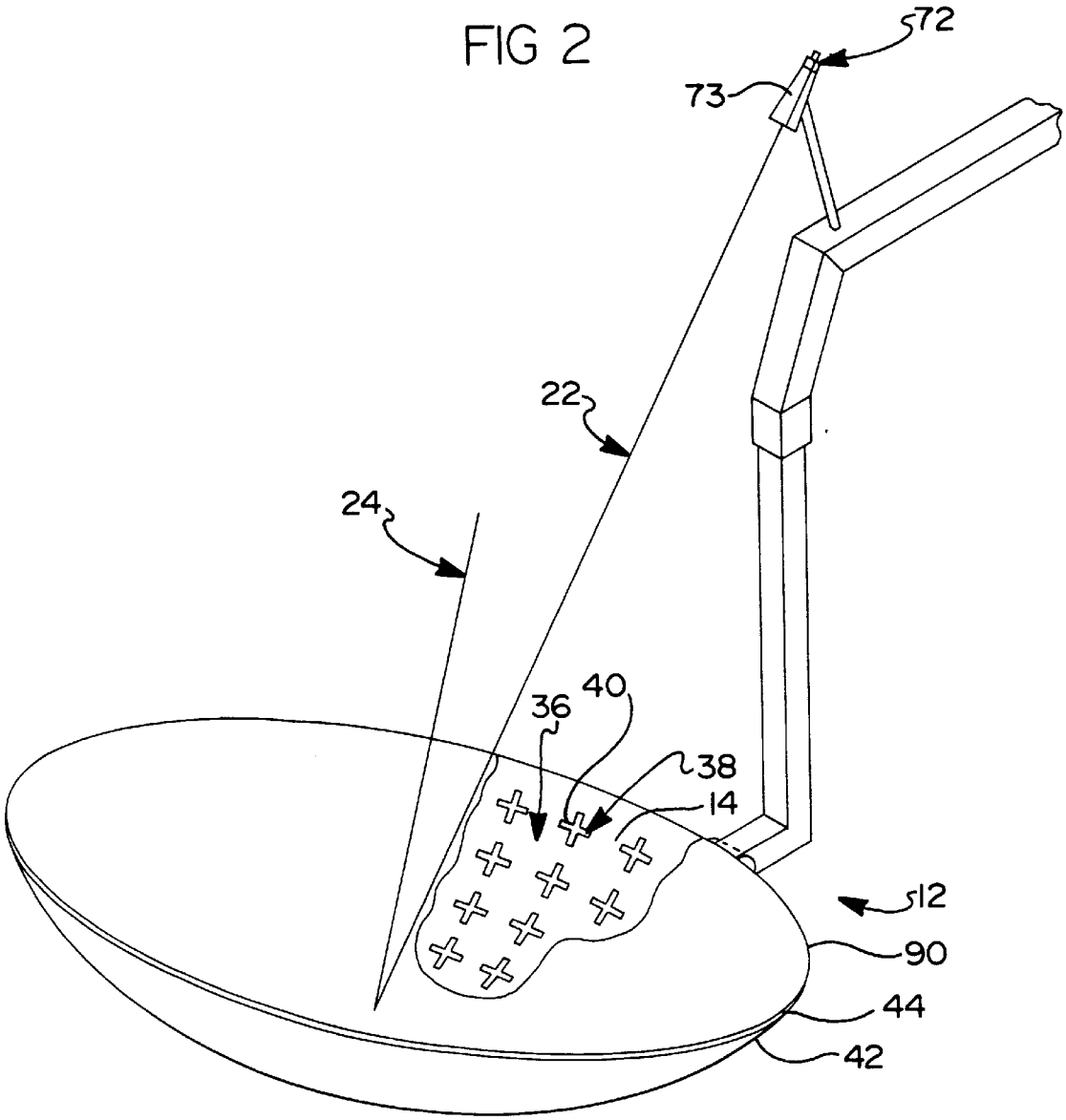
FIG. 2 is an enlarged view of a preferred reflectarray shown in FIG. 1 with parts broken away for the sake of clarity.

Referring first to FIG. 1, a satellite system 8 is shown with a payload communications system 10. The communication system 10 includes spaceborne, beam antenna 12 having a reflectarray surface, or surfaces 14 (FIG. 2). The communication system 10 operates in a signal transmission mode, a signal reception mode, or in both modes. Signal waves, preferably spherical waves, emanate from, or are collected at, feed point 16 including a feed 18 such as a wave guide horn 73 (FIG. 2). The feed 18 is connected to the radio frequency transmitter and/or receiver 20 in the system 10 via a transmission line such as waveguide or coaxial cable.

As shown in FIG. 2, ray path segments 22 and 24 indicate the relationship between the waves associated with the feed 18, the reflector surface 14, and the beam 26 (FIG. 1). In the transmission mode, the ray path segments 24 are focused by the reflectarray surface 14 to form a beam 26 (FIG. 1) collimated for coverage of a geographic reception area 28 (FIG. 1). The beam 26 (FIG. 1) may also be configured, for example to conform with the contour of the land mass 30 (FIG. 1), so that the reception area 28 (FIG. 1) overlaps the land mass 30.

The beam 26 is focused toward a geographic area by positioning an antenna 12. The antenna collimates a beam of ray segments 24 by constructing the reflectarray with a geometrically shaped surface 14, preferably, parabolic in shape as shown in FIG. 2. As used in this disclosure, reflectarray surface shaping refers to geometric or physical shaping of the reflectarray surface and does not require exact conformity with or departure from a parabolic shape. Rather, the descriptions are limited only by reference to the shaping necessary, in conjunction with surface phasing, to collimate a beam of specified shape and/or coverage area. Nevertheless, in the preferred embodiment, geometric shaping most nearly following the parabolic shape limits the reflectarray deficiencies that previously introduced substantial limitations to the pattern bandwidth.

The pattern bandwidth improvements offered by the present invention stem directly from reductions in the ray path electrical length variations. This reduction in ray path electrical length variations is graphically depicted by FIGS. 3 and 5. FIG. 3 shows a flat reflectarray 70 with a feed location 72. FIG. 4 shows the associated shaped beam contour pattern 74 at the design (center) frequency. A representative pair of overlaid contour beam patterns associated with the flat reflectarray include the solid line contour pattern 74 at the design (center) frequency and the dashed line contour 75 at the lower edge of the frequency band. An equivalent shaped reflector 76 which produces the same shaped beam contour pattern 74 is also shown for reference. A reference parabolic surface 78 is included for reference. Typical ray paths, 80 and 82, are shown for the flat reflectarray and shaped reflector, respectively. Each ray path 80 and 82 includes ray path segments 22 and 24 (FIG. 2) although the segment lengths differ in each path. The differential path length, in wavelengths, between rays 80 and 82 is shown encircled at 84.

FIG. 5 shows a parabolic reflectarray 90 with a feed 92. FIG. 6 shows an associated shaped beam contour pattern 94 at the design (center) frequency. A representative pair of overlaid contour beam patterns associated with the parabolic reflectarray of FIG. 5 include solid line contour pattern 94 at the design (center) frequency and the dashed line contour 95 at the lower edge of the frequency band. An equivalent shaped reflector 96 which produces the same shaped beam contour pattern is also shown for reference. Typical ray paths 98 and 100 are shown for the parabolic reflectarray 90 and shaped reflector 96, respectively. The differential path length, in wavelengths, between rays 98 and 100 is shown encircled at 86. It is readily apparent that the ray path difference, shown encircled at 84 in FIG. 3, is substantially greater than the ray path difference shown encircled at 86 for the parabolic reflectarray of FIG. 5. The smaller differential ray path lengths associated with the parabolic reflectarray 90 provide significant increases in pattern bandwidth. This is evident in comparing the contour patterns of FIGS. 4 and 6.

In the preferred embodiment, the parabolic shape of surface 14 will provide a focused pencil shaped beam in the absence of any reflectarray surface phasing. Referring again to FIG. 2, the reflectarray surface is then designed with a plurality of surface phasing elements 38 in order to further modify the beam shape. Each element 38 on the surface allows phase control of the scattered ray segments 24 from the incident ray segments 22. A standing wave is set up between the element 38 for example, a crossed dipole 40, and the ground plane 42 as shown in FIG. 2. The combination of the dipole reactance and the standing wave causes the ray segment 24 to be phase-shifted with respect to the incident ray segment 22. The phase shift is a function of the dipole length and thickness, distance from the ground plane, the dielectric constant of the support substrate 44, and the incident angle of ray segment 22, and the effect of nearby dipoles 40. Accordingly, the phase element pattern 36 produces a contoured beam 26 which covers the land mass shape 30.

Physically distinct phasing elements 38 are typically used, preferably including micro strip printed circuits. These circuits include conductors etched, plated, or conductively painted on a clad dielectric substrate. These manufacturing processes require photo chemical processes with relatively inexpensive materials which produce a monolithic structure capable of withstanding relatively high static and/or dynamic mechanical loads, temperature extremes, and other ambient conditions. Each phasing element is individually phased for example, by connection to a specific phase length of microstrip conductor, or by variation of the element size or shape characteristics to invoke inductive, capacitive, or resistive impedance variations or switchable diode operation in order to adjust the shape of the beam 26.

As a result, the present invention provides a method for improving bandwidth of a shaped beam pattern by parabolically shaping a reflector surface to focus the beam, and phasing the reflected ray segments to shape the beam by forming a reflectarray surface with a plurality of phasing elements that produce a contoured antenna beam. Accordingly, the present invention also provides a reflector for shaped beam antenna transmission or reception comprising a parabolic surface to generate a focused beam from an impinging source beam, and surface phasing elements carried by the parabolic surface for configuring the focused beam. As a result, the present invention provides the advantages of substantially increased bandwidth over previously known reflectarrays.

Having thus defined the present invention, many modifications are to become apparent to those skilled in the art to which it pertains without departing from the scope and spirit of the present invention and as defined in the appended claims.

What is claimed is:

1. A method for forming a shaped beam using a shaped beam antenna having a reflector surface and a plurality of phasing elements, the method comprising:

geometrically shaping a flat reflector surface towards a parabolic shape to focus a desired spot beam and reducing ray path electrical length variations between the flat reflector surface and the reflector surface geometrically shaped to focus a desired shaped beam; and reflectively shaping the desired spot beam to the desired shaped beam by forming a reflectarray surface with a plurality of phasing elements configured to contour the outline of the desired shaped beam and further reducing variation of ray path electrical lengths between the flat reflector surface and the reflector surface geometrically shaped to focus the desired shaped beam wherein the shape of the desired shaped beam lacking a plane of symmetry.

2. The invention as defined in claim 1 wherein said reflectively shaping step comprises arranging physically distinct phasing elements on said reflectarray surface.

3. The invention as defined in claim 2 wherein said phasing elements are discrete antenna elements.

4. The invention as defined in claim 3 wherein said discrete elements include dipole antenna elements.

* * * * *